US005788229A

United States Patent [19]

Asami et al.

[11] Patent Number: 5,788,229

[45] Date of Patent: Aug. 4, 1998

[54] PATH GUIDE FOR SELECTIVELY CORRUGATING AN OUTPUT MEDIUM

[75] Inventors: Shinji Asami, Saitama-ken; Yoshiaki Ushirogata, Tokyo-to; Hiroyuki Ishizaki, Ogaki; Minoru Hattori, Seto; Terumitsu Azuma, Okazaki, all of Japan

[73] Assignee: Ricoh Co., Ltd., Tokyo, Japan

[21] Appl. No.: 518,041

[22] Filed: Aug. 22, 1995

[30] Foreign Application Priority Data

| | | | |
|---|---|---|---|
| Aug. 29, 1994 | [JP] | Japan | 6-203686 |
| Sep. 9, 1994 | [JP] | Japan | 6-216096 |
| Nov. 9, 1994 | [JP] | Japan | 6-275086 |

[51] Int. Cl.[6] ..... B65H 39/10

[52] U.S. Cl. ..... 271/305; 271/303; 271/297; 271/188

[58] Field of Search ..... 271/288, 297, 271/298, 303, 305, 188, 304, 270

[56] References Cited

U.S. PATENT DOCUMENTS

| | | | |
|---|---|---|---|
| 4,026,540 | 5/1977 | Lawrence | 271/173 |
| 4,998,716 | 3/1991 | Okumura et al. | 271/305 |
| 5,104,118 | 4/1992 | Hamanaka | 271/305 |
| 5,201,518 | 4/1993 | Isoda | 271/297 |
| 5,282,611 | 2/1994 | Ueda et al. | 271/270 |
| 5,312,108 | 5/1994 | Hayashi | 271/188 |
| 5,346,205 | 9/1994 | Lawrence | 271/297 |
| 5,382,012 | 1/1995 | Mandel et al. | 270/53 |

FOREIGN PATENT DOCUMENTS

| | | | |
|---|---|---|---|
| 54-27017 | 5/1977 | Japan . | |
| 58-109357 | 6/1983 | Japan . | |
| 58-125060 | 7/1983 | Japan . | |
| 59-99455 | 6/1984 | Japan . | |
| 0203053 | 11/1984 | Japan | 271/188 |
| 60-88970 | 5/1985 | Japan . | |
| 61-8664 | 1/1986 | Japan . | |
| 61-269169 | 11/1986 | Japan . | |
| 62-16984 | 1/1987 | Japan . | |
| 62-121179 | 6/1987 | Japan . | |
| 62-180869 | 8/1987 | Japan . | |
| 0008160 | 1/1988 | Japan | 271/303 |
| 401036472 | 2/1989 | Japan | 271/303 |
| 64-64969 | 3/1989 | Japan . | |
| 0013566 | 1/1990 | Japan | 271/303 |
| 3-23153 | 1/1991 | Japan . | |
| 3-205260 | 9/1991 | Japan . | |
| 3-259861 | 11/1991 | Japan . | |
| 4-64571 | 2/1992 | Japan . | |
| 5-32365 | 2/1993 | Japan . | |
| 5-43110 | 2/1993 | Japan . | |
| 5-294533 | 11/1993 | Japan . | |
| 6-345312 | 12/1994 | Japan . | |

*Primary Examiner*—H. Grant Skaggs

*Attorney, Agent, or Firm*—Woodcock Washburn Kurtz Mackiewicz & Norris LLP

[57] ABSTRACT

A method and an apparatus for corrugating the output of a reproduction device such as a photocopier includes a guiding arm for guiding an image carrying medium in a predetermined path towards a destination output bin and a projection for corrugating the image carrying medium as it is being guided by the guiding arm. The current corrugation device is suitable for a multiple tray sorter unit since it does not require additional corrugation members.

12 Claims, 9 Drawing Sheets

PATH GUIDE FOR SELECTIVELY CORRUGATING AN OUTPUT MEDIUM

FIELD OF THE INVENTION

This invention relates generally to a corrugation device to be used in a reproduction apparatus for corrugating an image carrying output medium as the output medium is delivered to an output location, and is more particularly related to a path guide or a roller having a projection for selectively causing the output medium such as a sheet of paper to be corrugated when the path guide or the roller is placed is a predetermined position to guide the sheet to the output bin of an reproduction apparatus such as a copier, a facsimile machine, and a printer.

BACKGROUND OF THE INVENTION

In general, in order to reproduce an image on an image carrying medium, the image carrying medium travels a predetermined path in an image reproduction apparatus such as copiers, facsimile machines and printers. The image carrying medium, such as a sheet of paper or a transparency, is stored in a paper cartridge, and each sheet is first fed towards image reproducing members to reproduce an image on its image carrying surface. The processed sheet resumes its travel towards the output area by means of transfer rollers located along the predetermined path.

As an image carrying medium is delivered to an output area such as an output tray, the image carrying medium is placed on the top of the previously delivered image carrying medium mainly due to inertia exerted by an output roller located near the output tray. A sheet of paper is particularly susceptible to the strength of the inertia and is often adversely affected in its ability to neatly piled on the output tray. For example, if the inertia is too large, a sheet may push against a previously outputted sheet on the pile, and the pile may not be kept neatly. On the other hand, if the inertia is too small, the sheet does not correctly stack on the pile. The thickness and hardness of paper also determine the correct amount of the inertia. If the paper is thin and soft, the inertia tends to cause bending or folding of the paper. In addition, since some sheets may be curled after the image reproduction process, they may not be smoothly outputted or may not be piled neatly on the output tray.

To attempt to solve some of the above-described problems, Japanese Patent 4-64571 discloses a copier equipped with a sorter having multiple output trays. A pair of an output roller and a corresponding guide is disposed near one end of each output tray. As a processed image carrying medium reaches the output area of the above described sorter, a selectively activated pair of the guide and the output roller determines to which output tray the processed image carrying medium is delivered. As illustrated in FIG. 1, a processed image carrying medium 20 is travelling from the bottom of a paper path 40 towards the top, and a guide 32 is not selectively activated to guide the image carrying medium 20 towards its corresponding output roller 38. Consequently, the image carrying medium 20 further travels towards an adjacent guide 30. The guide 30 is selectively placed in a position to close the paper path 40 so that the processed image carrying medium 20 is guided towards the corresponding output roller 36. Thus, the image carrying medium 20 is delivered onto a middle output tray 24 with a predetermined amount of inertia provided immediately before the release of the medium onto the output tray 24. The predetermined inertia improves the above described stacking problems on the output tray to some extent.

To improve stacking of delivered image carrying media on an output tray, Japanese Utility Model Patents 61-8664 and 54-27017 disclose a projection placed along the central longitudinal axis of the output tray surface. As the processed image carrying medium, such as a sheet of paper, is delivered on to the output tray surface, the central portion of the sheet is corrugated by the projection to increase the stacking characteristics of the sheet. In a similar line of efforts, to more efficiently stack curled sheets, Japanese Patent 59-99455 also discloses a curved projection located at an end of the output tray proximate to a paper ejection outlet. The semi-circular projection helps to relax the curl while it substantially prevents the curled sheet from falling off the output tray. However, these projections do not necessarily improve stacking characteristics of all type of image carrying media. For example, a thin soft paper may be still bent as it reaches the above described projections.

To further improve the above image carrying medium delivery system, an output image carrying medium is corrugated as it is delivered onto an output tray. For example, Japanese Patent 3-23153 discloses pairs of opposing output rollers of different sizes to corrugate a sheet of paper as it is delivered onto the output tray. Instead of opposing rollers, Japanese Patent 5-32365 discloses a set of projections placed near output rollers to corrugate a sheet of paper. Similarly, Japanese Patent 5-43110 discloses a corrugation device that folds the leading corners of a sheet upwardly with respect to an output tray surface so as to substantially reduce a resistance caused by the corrugation to lay flat on the output tray during the delivery. In general, the above described corrugation devices are fixedly placed in the paper path, and they are designed to accommodate a predetermined image carrying medium having a certain thickness and hardness.

To accommodate various types of image carrying media, Japanese Patent 58-109357 discloses adjustable rollers that corrugate the image carrying media by their weights. These rollers each have a central bore whose diameter is larger than that of a rod on which they are located and vertically movable as the image carrying medium is corrugated by their weights. In general, thin and soft sheets are more readily corrugated than thick and hard sheets.

In the above described prior art references, no corrugation device is particularly directed to multiple-tray sorter units. The application of the above described corrugation device generally would requires additional parts or space in the multiple-tray sorter. If one of these corrugation devices is used in the above described multiple-tray sorter in which the output medium is delivered to a tray through a separate outlet, the additional corrugation components must be duplicated for each of the multiple outlets. To provide the corrugation capability to the multiple-tray sorter without adding a dedicated corrugation device or increasing the sorter size, the current invention is directed to a corrugation device that is advantageous in the above described multiple-tray sorter.

SUMMARY OF THE INVENTION

To solve the above problems, one preferred embodiment of the current invention includes a corrugating device for corrugating a sheet of paper traveling in one of a plurality of predetermined paper paths, which comprises: a guiding arm portion for guiding the sheet in one of the predetermined paths, the guiding arm having a first outer surface and a second outer surface, the sheet being guided by the first outer surface when the guiding arm is positioned at a first position, the sheet being guided by the second outer surface when the guiding arm is positioned at a second position; and a projection located on the first outer surface of the guiding arm for applying a pressure on the sheet so as to corrugate the sheet, wherein the sheet is selectively corrugated when the guiding arm is at the first position.

According to a second aspect of the current invention, an adjustable corrugation device for corrugating a sheet of paper moving in a predetermined paper path, the sheet having a thickness comprises a guiding arm portion placed in the paper path for guiding the sheet in a predetermined direction, the guiding arm having an outer surface, the sheet being guided by the outer surface; and an adjustable projection located on the outer surface of the guiding arm, the adjustable projection corrugating the sheet in response to the thickness of the sheet.

According to a third aspect of the current invention, a selective corrugation system for delivering an output sheet comprises a plurality of bins for temporarily storing the output sheet; a controller unit for determining one of the plurality of bins as an output bin and generating a signal indicative of sending the output sheet to the output bin; transferring rollers in response to the signal for transferring the output sheet in a predetermined path towards the output bin; a plurality of guides movably located in the predetermined path adjacent to the transferring rollers for guiding the output sheet to the output bin in response to the signal, one of the guides at a delivery position delivering the output sheet onto the output bin, others of the guides at a guiding position guiding the output sheet towards the output bin, each of the guides further comprising a corrugating projection for selectively causing corrugation on the output sheet when the one of the guides is positioned at the delivery position.

According to a fourth aspect of the current invention, a corrugation device for corrugating an output medium comprises a first roller rotating in a first direction and having a first contact surface; a second roller rotating in a second direction opposite to the first direction and having a second contact surface; and a first projection located on the first contact surface for causing the output medium placed between the first contact surface and the second contact surface to be corrugated.

According the fifth aspect of the current invention, a method of corrugating an output medium before delivering to a selected output bin using guides, each guide having a projection comprises the steps of a) placing the guides in a predetermined position so as to select a path to the selected output bin, one of the guides adjacent to the selected output bin being positioned in a delivery position to define a corrugation guide; b) transferring the output medium according to the selected path towards the selected output bin; and c) corrugating the output medium as the output medium is guided by the corrugation guide.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
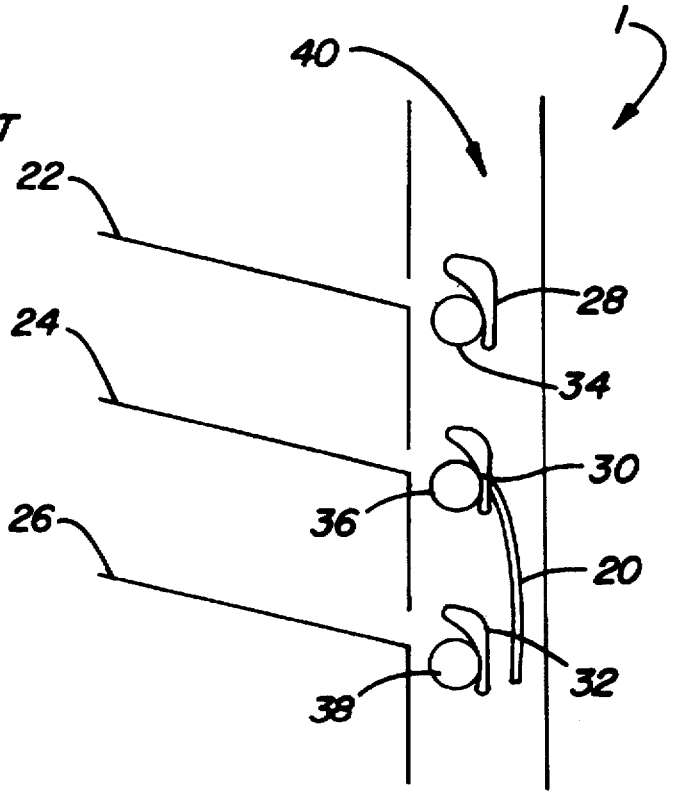
FIG. 1 PRIOR ART
FIG. 1 is a diagrammatical cross sectional view of a prior art multiple-tray sorter with guides for guiding an output medium towards a predetermined tray.
Figure 2:
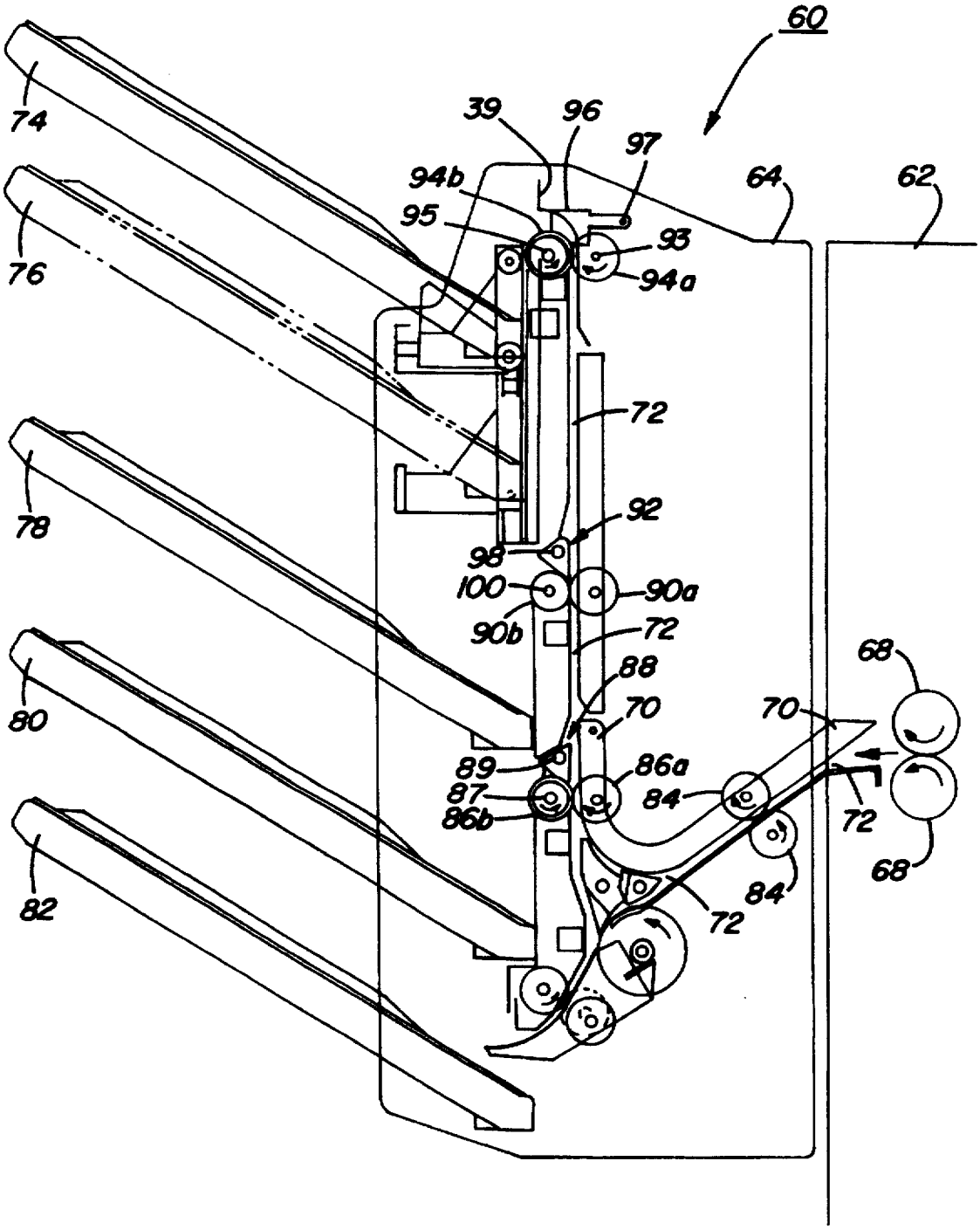
FIG. 2 is a diagrammatical cross sectional view of a multiple-tray sorter with one preferred embodiment of the corrugation device according to the current invention.

Referring now to the drawings, wherein like reference numerals designate corresponding structure throughout the views, and referring in particular to FIG. 2, an overview of an image forming system such as an electrophotographic copier 60 is shown. An image carrying medium such a sheet of paper is processed in an image forming unit 62 and delivered towards a multi-tray sorter unit or output unit 64 via a first pair of transfer rollers 68. As the processed image carrying medium enters the sorter unit 64, a pair of guiding plates 70 in part defines a predetermined paper path 72 towards output trays 74, 76, 78, 80 and 82. The image carrying medium is further transported along the paper path 72 by a second pair of transport rollers towards a first pair of output rollers 86 which is located adjacent to a first output tray 80. Adjacently located to the first output rollers 86 is a first guide 88.

As shown in FIG. 2, since a predetermined destination output tray for the image carrying medium is a second output tray 78, the first guide is in a de-activated position. Thus, first guide 88 does not interfere with the paper path 72 and the image carrying medium is transported further upward by the first output rollers 86 towards a second pair of output rollers 90. Before the image carrying medium approaches the second output rollers 90, a second guide 88 is selectively positioned in an activated position so that the guide interferes the paper path 72. Because of this paper path interference, the image carrying medium is nipped between the second guide 92 and the second output roller 90 and is led out of the paper path 72 towards the second output tray 78. Similarly, if the image carrying medium is to be delivered to other output trays such as 74 or 76, the paper path 72 is left intact by intervening guides such as 88 and 92 and the immediately adjacent guide such as a guide 96 located adjacent to the predetermined destination output tray is selectively activated in advance so that the activated guide engages the image carrying medium for the delivery. In this example, the output trays 74 and 76 are vertically movable so a single guide 96 delivers either of the output trays 74 and 76.

Figure 3:
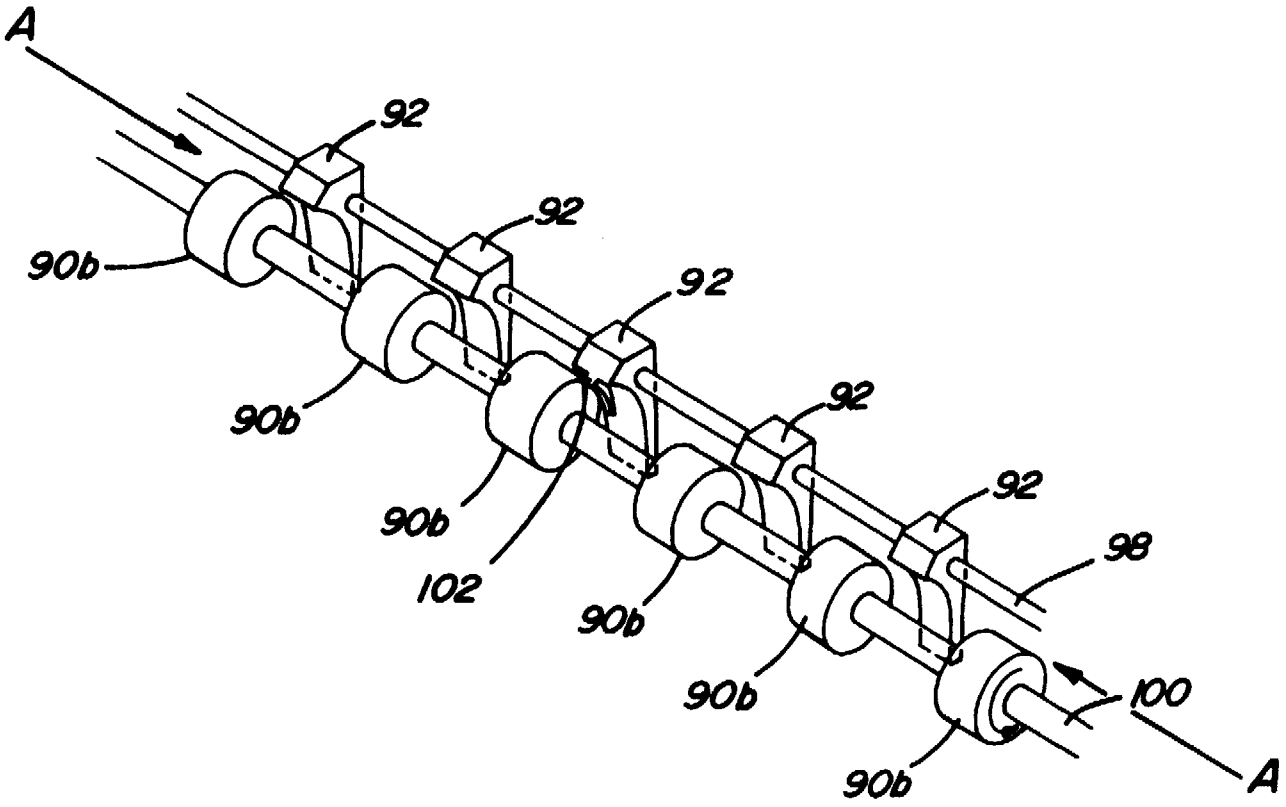
FIG. 3 is a perspective view of the preferred embodiment of the corrugation device.

Referring to FIG. 3, one preferred embodiment of the guides 92 and the output rollers 90 according to the current invention are shown in a perspective view. A predetermined number of the guides 92 are fixedly positioned at the same angle with respect to each other along a guide control rod 98. At least one of the guides 92 has a projection or a corrugation member 102 on an inner surface of the guide facing the output roller **90*b*. The function of this projection 102 will be later described in detail in relation to FIG. 6. In parallel to the guide control rod 98, a predetermined number of output rollers 90*b* is also fixedly positioned along a roller driving rod 100. The guide control rod 98 is positioned at a predetermined distance from the roller driving rod 100. Thus, as the rod 98 turns in a predetermined direction, each guide 92 maintains the same angle and distance with respect to the corresponding rollers 90*b***.

Referring back to FIG. 2, other guides 88 and 96 are also fixedly positioned on corresponding guide control rods 89 and 97, and output rollers **86*b* and 94*b* are also fixedly positioned on corresponding roller driving rods 87 and 95 in a similar manner as described above in relation to FIG. 3. Each of the guide control rods 89, 97 and 98 as well as each of the roller driving rods 87, 95 and 100** is independently operated.

Figure 4A:
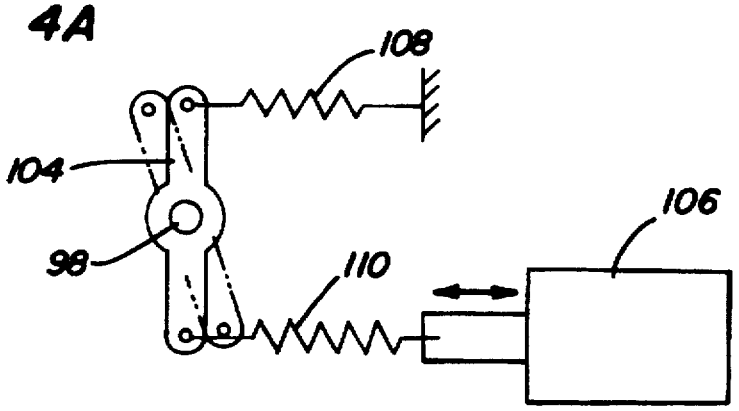
FIG. 4A diagrammatically illustrates a first embodiment for an activation mechanism to selectively activate the corrugation device.
Figure 4B:
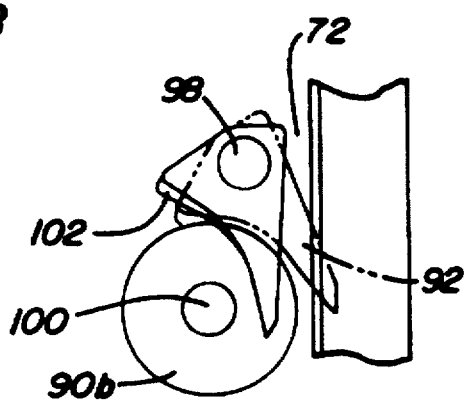
FIG. 4B illustrates a activated position and a de-activated position of the corrugation device which is selectively placed by the mechanism illustrated in FIG. 4A.

Now referring to FIGS. 4A and 4B, according one preferred embodiment of the current invention, one end of the guide control rod 98 is connected to a position control rod 104. The guide control rod 98 is rotated via the position control rod 104 by a drive motor or solenoid 106, which is connected one end of the position control rod 104. According to this preferred embodiment, the position control rod 104 is urged by a pair of springs 108 and 110 so that the guides 92 are flexibly positioned between at least the activated position and the deactivated position as described above. At either position, the guides 92 are not rigidly positioned with respect to the output rollers **90*b* and may be rotatably adjusted as the springs flexibly urge in opposite directions. The guides 92 at the activated position as indicated in dotted lines interfere the paper path 72 and place the projection 102 to overlap the outer diameter of the output roller 90*b* as shown in FIG. 4B. In contrast, the guides 92 at the deactivated position as indicted in solid lines do not interfere with the paper path 72 and place the projection 102 away from the output roller 90*b***.

Figure 5:
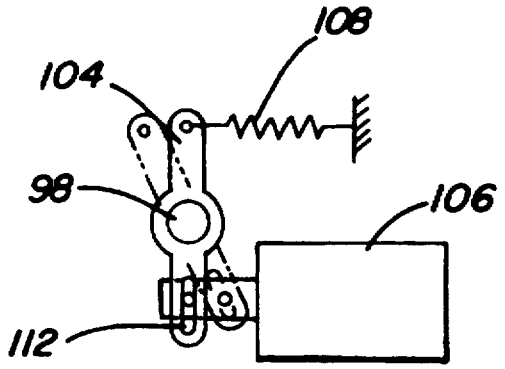
FIG. 5 diagrammatically illustrates a second embodiment for an activation mechanism to selectively activate the corrugation device according to the current invention.

Referring to FIG. 5, according to a second embodiment of the current invention, one end of the guide control rod 98 is connected to a position control rod 104. The guide control rod 98 is rotated via the position control rod 104 by a drive motor or solenoid 106. According to this preferred embodiment, the position control rod 104 is urged by only one spring 108 located at one end of the position control rod 104. The other end of the position control rod 104 has a slit 112, and a projection located at the end of the solenoid 106 directly engages the slit 112. Due to the above direct connection, the position control rod 104 is substantially rigid at the predetermined positions.

Figure 6:
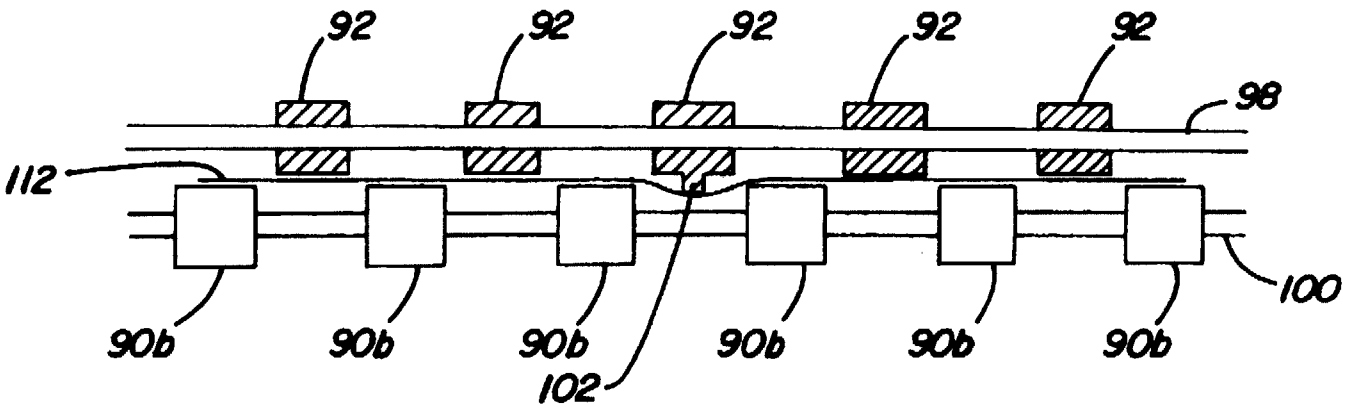
FIG. 6 illustrates a cross sectional view of the corrugation device taken across a line A—A shown in FIG. 3.

FIG. 6 shows a cross sectional view taken at a line A—A as shown in FIG. 3 when the activated guides 92 and the output rollers **90*b* nip an image carrying medium such as a sheet of paper 112. When the guides 92 are positioned at the activated position, the projection 102 is placed at a position that overlap the outer surface of the output rollers 90*b*. Due to this overlap, as the paper 112 is guided by the activated guides 92 and advanced by the output rollers 90*b*, the projection 102 causes the paper 112 to be corrugated in a direction perpendicular to the advancing direction. As described above, according to the current invention, additional projections may be placed on other guides 92**, and or multiple projections may be placed on the same guide. In addition, one embodiment of the current corrugation device is incorporated into the guiding mechanism, a separately dedicated corrugation device is substantially eliminated.

The above described corrugation on the paper surface obtained through the corrugation device of the current invention substantially improves the stacking characteristics of the sheet 112 as it is piled onto an output tray. Among other things, the corrugated sheet 112 provides substantial resistance to undesirable bending of the sheet during the delivery process onto the output tray. Since the above described corrugation device is located immediately adjacent to a destination output tray, the corrugation is concurrently made as the sheet is being outputted by the output roller. This arrangement allows the corrugated sheet to be outputted with sufficient inertia to be stacked onto a pile.

Figure 7:
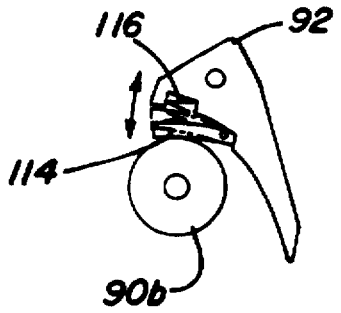
FIG. 7 illustrates a cross sectional view of a second embodiment of the corrugation device according to the current invention.

Referring to FIGS. 7, according to the current invention, the corrugating device is capable of adjusting pressure in response to the thickness of an image carrying medium. A guide 92 further comprises an adjustable projection 114 whose one end is pivoted, and the adjustable projection 114 is urged by a spring 116 towards an outer surface of the output roller **90*b*. When the image carrying medium of a certain thickness is nipped between the adjustable projection 114 and the output roller 90*b*, due to the thickness, the position of the adjustable projection 114 with respect to the output roller 90*b* is flexibly adjusted for corrugation. In general, assuming that the image carrying medium cannot be compressed across its thickness, the thicker the image carrying medium is, the more the adjustable projection is pushed back away from the output roller to cause a substantially constant amount of corrugation on the image carrying medium. In another case, regardless of the thickness, if the image carrying medium is hard or rigid, the adjustable projection is also pushed away from the output roller. In either case, the adjustable projection 114 substantially prevents the image carrying medium from being damaged due to an undesirably high pressure applied to its surface. The adjustable projection 114** also substantially reduces undesirable friction between the projection and the image carrying medium so that the output roller easily advances the image carrying medium in a redetermined direction.

Figure 8:
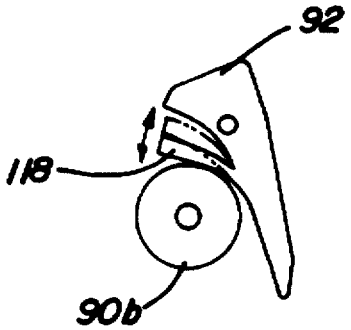
FIG. 8 illustrates a cross sectional view of a third embodiment of the corrugation device according to the current invention.

Now referring to FIG. 8, according to another embodiment of the adjustable projection, the guide 92 further comprises a flexible projection 118 which is made of a flexible material such a plastic resin including a ABS resin and a POM resin. When the flexible projection 118 is placed at the above described activated position for corrugation, if an image carrying medium is relatively thick or hard, the flexible projection 118 is compressed and yield more space between the image carrying medium and the output roller. As described above, the flexible projection 118 also substantially reduces undesirable damage to the image carrying medium and at the same time allows a smooth advancement of the image carrying medium through the guide.

Figure 9:
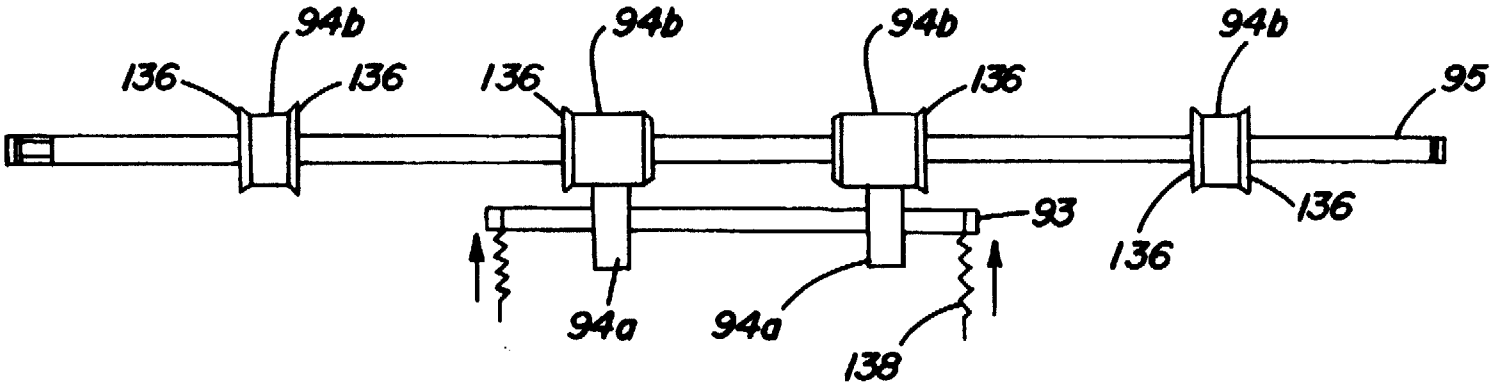
FIG. 9 illustrates a top view of an alternative embodiment for the corrugation device according to the current invention.

FIG. 9 illustrates a top view of the fourth embodiment of the current invention. The fourth embodiment includes output rollers 94b and an opposing output rollers 94a that are located at the top of the paper path 72 near an output tray 74 as shown in FIG. 2. The output rollers 94b have projections 136 on at least one side along their edges and fixedly located on the roller driving rod 95. The opposing output rollers 94a fixedly located on a roller driving rod 93 have no projection in this embodiment and oppose the two middle output rollers 94b. The opposing output rollers are urged against the output rollers 94b by springs 138. When an image carrying medium is nipped between the two output rollers 94a and 94b, the projections 136 cause the image carrying medium to be corrugated in a direction perpendicular to the moving direction.

Figure 10:
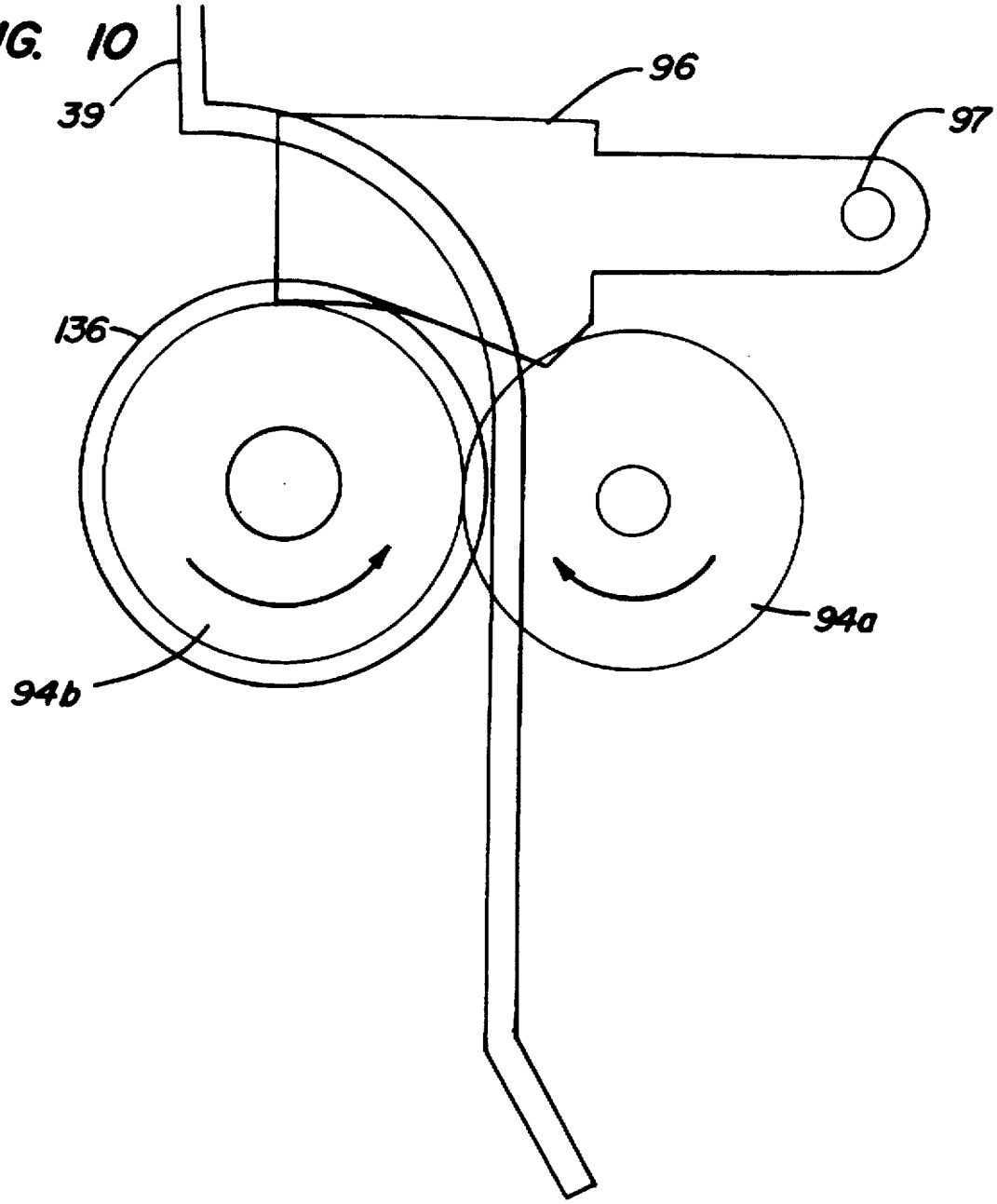
FIG. 10 illustrates a cross sectional view of yet another embodiment for the corrugation device according to the current invention.

Now referring to FIG. 10, a fifth embodiment of the current invention is illustrated in a cross sectional view. The fifth embodiment includes the above described pair of output rollers 94a and 94b, a path guide 39 and a guide 96. The path guide defines a part of the paper path 72, and as it extends outwardly away from the output roller 94b, the distance between the path guide 39 and the output roller 94b increases. Although the guide 96 is similar to other guides 92 and 88, the guide 96 does not function as a divider in a paper path. As described above, the output roller 94b has the projection 136 along its edge. Thus, when an image carrying medium is nipped by the output rollers 94a and 94b, the image carrying medium is corrugated by the projection 136 and the guide 96, which applies pressure on the image carrying medium by its own weight. In general, a soft or thin image carrying medium is corrugated by the guide 96 and the projection 136 and guided by the guide 96 towards the output tray 74. In this alternative embodiment of the guide 96, there is no projection. On the other hand, a hard or thick image carrying medium is corrugated by the projection 136 and guided by the path guide 39 towards the output tray 74. As the hard or thick image carrying medium is corrugated, since it resists bending, the leading edge of the medium follows the contour of the path guide 39. Since the distal end of the path guide 39 extends away from the output roller 94b, the hard or thick image carrying medium is not damaged by forced bending.

Figure 11:
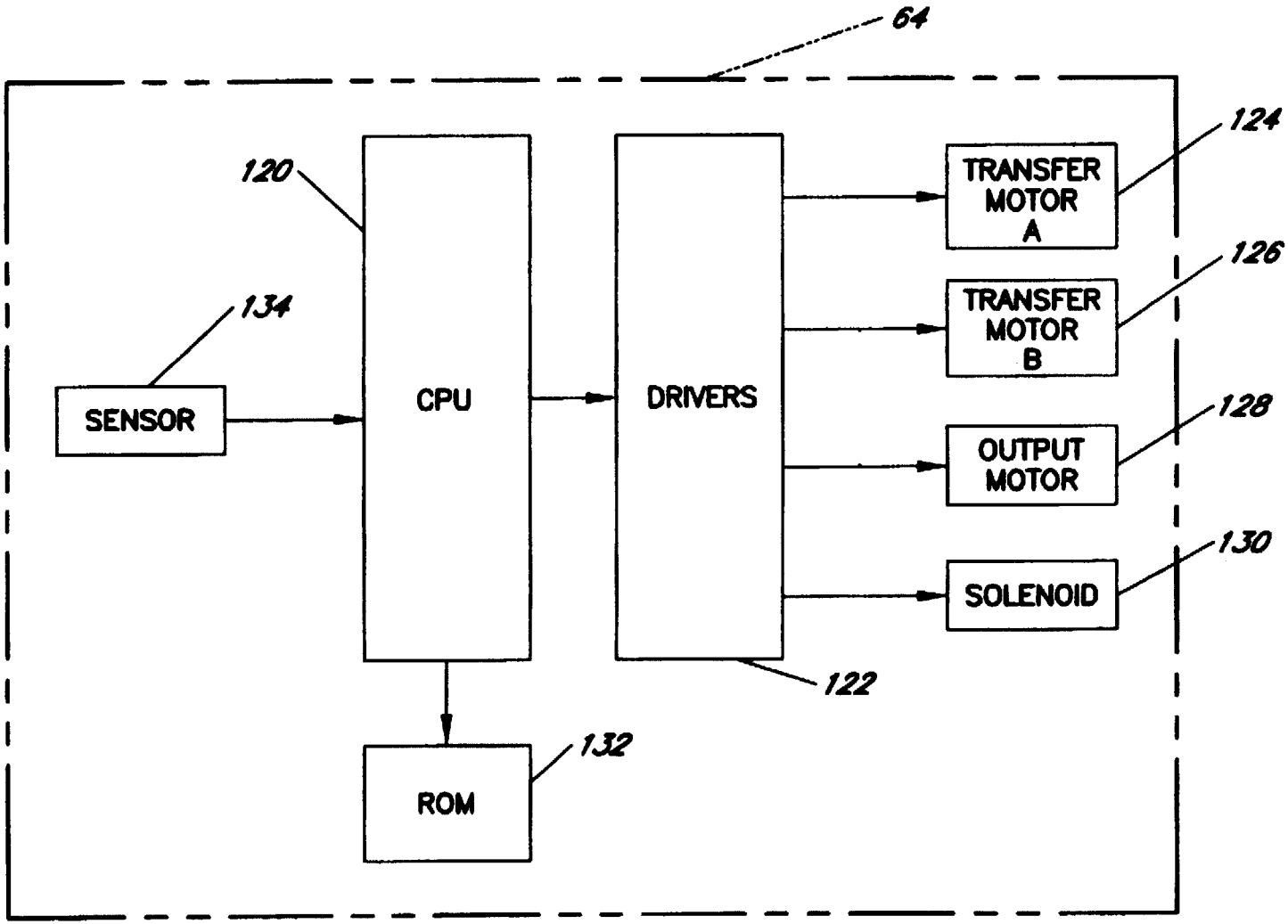
FIG. 11 is a block diagram for depicting the control of components of the corrugation device.

The above described guides 88, 92 and 96 are generally controlled by a central CPU 120 and a ROM 132 of the sorter unit 64 as depicted in FIG. 11. According to software stored in the ROM 132, as an image reproduction takes place, the central CPU 120 sends a signal to a driver 122 to indicate a predetermined output tray where the image carrying medium is outputted. The driver 122 in turn activates a transfer motor A 124 which drives a first pair of transfer rollers located in a paper path; a transfer motor B 126 which drives a second pair of transfer rollers located in a paper path; and an output motor 128 which drives an output roller. At the same time, the driver 122 also activates a solenoid 130 corresponding to the predetermined output tray, and the guide is placed in the activated position to guide the image carrying medium towards the predetermined output tray. As the image carrying medium is delivered through the guide and the output roller, the output roller is rotated at a predetermined speed. As the end of the image carrying medium approaches the guide, a sensor 134 sends a signal to the CPU. In response, the CPU sends another signal to the driver 122 so as to slow down the output roller rotational speed. Thus, the image carrying medium is delivered on the predetermined output tray under optimal stacking conditions.

Figure 12:
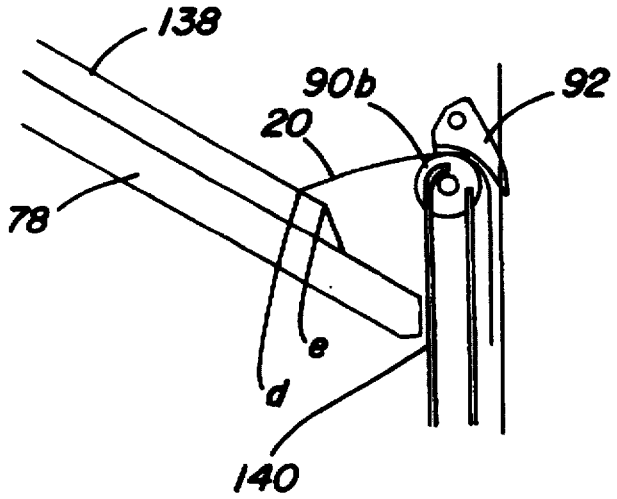
FIG. 12 illustrates a relative distance between the image carrying medium and an output tray as it is being corrugated by the corrugation device of the current invention.

Any of the above-described embodiments of the current invention may be used in combination with an output tray as shown in FIG. 12. The output tray 78 has a center projection 138, but it does not extend all the way to an end fence 140. The center projection 138 extends beyond a point d where the corrugated image carrying medium 20 contacts the top of the center projection 138. This extension assures that the image carrying medium 20 to land on the center projection 138. As the corrugated image carrying medium is delivered and placed on the output tray 78, the center portion of the image carrying medium is lifted to further improve the stacking characteristics of the image carrying medium. The center projection 138 lifts the image carrying medium 20 in an opposite direction to the corrugation caused by the guide 92 and the roller 90b. In addition, since the projection 138 does not extend to the proximal area of the output tray, the proximal end of the image carrying medium is not lifted and lays more readily flat on the output tray 78. Such a partial lifting improves overall stacking characteristics of the delivered image carrying medium.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A corrugating device for corrugating a sheet of paper traveling in one of a plurality of predetermined paper paths, comprising:

a movable guiding arm portion for guiding the sheet in one of the predetermined paths, said guiding arm having a first outer surface and a second outer surface, the sheet being guided by said first outer surface when said guiding arm is adjustably positioned substantially near a first position, the sheet being guided by said second outer surface when said guiding arm is positioned at a second position; and a projection located on said first outer surface of said guiding arm for adjustable applying a pressure on the sheet so as to corrugate the sheet, wherein the sheet is selectively corrugated when said guiding arm is substantially near said first position.

2. The corrugating device according to claim 1 further comprising a rotatable rod, said guiding arm being fixedly located on the rotatable rod for rotating the guiding arm between said first position and said second position.

3. The corrugating device according to claim 2 wherein said projection rotates for adjusting said pressure.

4. The corrugating device according to claim 1 wherein said projection comprises means for adjusting said pressure in response to a thickness of the sheet of paper.

5. The corrugating device according to claim 4 wherein said adjusting means further comprises a spring for adjusting said pressure.

6. The corrugating device according to claim 4 wherein said projection is made of a flexible material so as to adjust said pressure.

7. A selective corrugation system for delivering an output sheet, comprising:

a plurality of bins for temporarily storing the output sheet;

a controller unit for determining one of said plurality of bins as an output bin and generating a signal indicative of sending the output sheet to said output bin;

transferring rollers in response to said signal for transferring said output sheet in a predetermined path towards said output bin;

a plurality of guides movably located in said predetermined path adjacent to said transferring rollers for adjustably guiding the output sheet to said output bin in response to said signal, one of said guides substantially at a delivery position delivering the output sheet onto said output bin, others of said guides at a substantially guiding position adjustably guiding the output sheet towards said output bin, each of said guides further comprising a corrugating projection for causing a desired amount of corrugation on said output sheet when said one of said guides is adjustably positioned substantially near said delivery position.

8. The selective corrugation system according to claim 7 wherein said transferring rollers are a pair of opposing rollers, said opposing rollers each having a contacting surface for contacting said output, a projection being integrally formed on said contacting surface for causing said output to corrugate.

9. The selective corrugation system according to claim 8 wherein said contacting surface has an edge, said projection being located at said edge.

10. A method of corrugating an output medium before delivering to a selected output bin using guides, each guide having a projection, comprising the steps of:

a) adjustable placing the guides in a predetermined position so as to select a path to the selected output bin, one of said guides adjacent to the selected output bin being adjustably positioned in a delivery position and defining a corrugation guide;

b) transferring the output medium according to the selected path towards the selected output bin; and c) selectively corrugating the output medium at the projection as the output medium is adjustably guided by said corrugation guide and a desired amount of corrugation force is applied by the projection.

11. The method of corrugating the output medium according to claim 10 wherein said step c) corrugates the output medium in a direction perpendicular to a direction of transferring of said step b).

12. The method of corrugating the output medium according to claim 10 further comprises:

d) further transferring the output medium on to said selected output bin, a speed of transfer in said step d) being slower than the speed of transfer in said step b).

* * * * *